United States Patent [19]

de Polo

[11] 4,240,158

[45] Dec. 23, 1980

[54] PANTS-TYPE GARMENT AND METHOD OF MAKING THE SAME

[76] Inventor: Harry R. de Polo, 480 Park Ave., New York, N.Y. 10022

[21] Appl. No.: 54,478

[22] Filed: Jul. 3, 1979

Related U.S. Application Data

[63] Continuation-in-part of Ser. No. 921,181, Jul. 3, 1978.

[51] Int. Cl.[2] ..... A41D 1/06; A41D 17/02

[52] U.S. Cl. ..... 2/227; 2/243 B

[58] Field of Search ..... 2/227, 238, 243 B

[56] References Cited

U.S. PATENT DOCUMENTS

| | | | |
|---|---|---|---|
| 2,703,404 | 3/1955 | Lawson | 2/227 |
| 3,143,741 | 8/1964 | Tyroler | 2/227 |

*Primary Examiner*—Doris L. Troutman

*Attorney, Agent, or Firm*—Robert E. Burns; Emmanuel J. Lobato; Bruce L. Adams

[57] ABSTRACT

A pants-type garment comprises two panels of material each comprising a lower leg-forming portion and an upper body-forming portion having a contoured edge defining a generally U-shaped cutout for the formation of a crotch. A crotch band has opposite side edges joined respectively with the contoured edges of the two panels to unite the panels and thereby form a body portion of the garment. Each of the two panels may be a band of material which is wound helically to form a leg of the garment with adjacent edges of successive convolutions stitched together.

14 Claims, 8 Drawing Figures

FIG. 5A
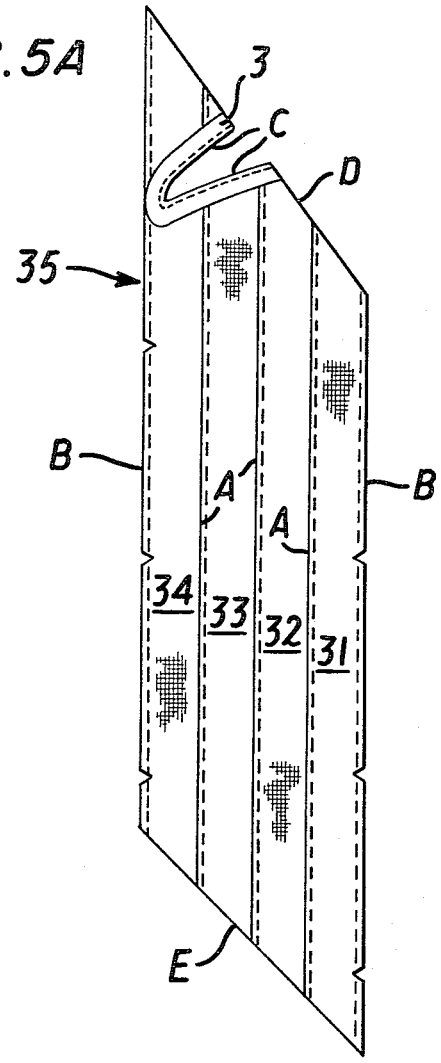
FIG. 5B
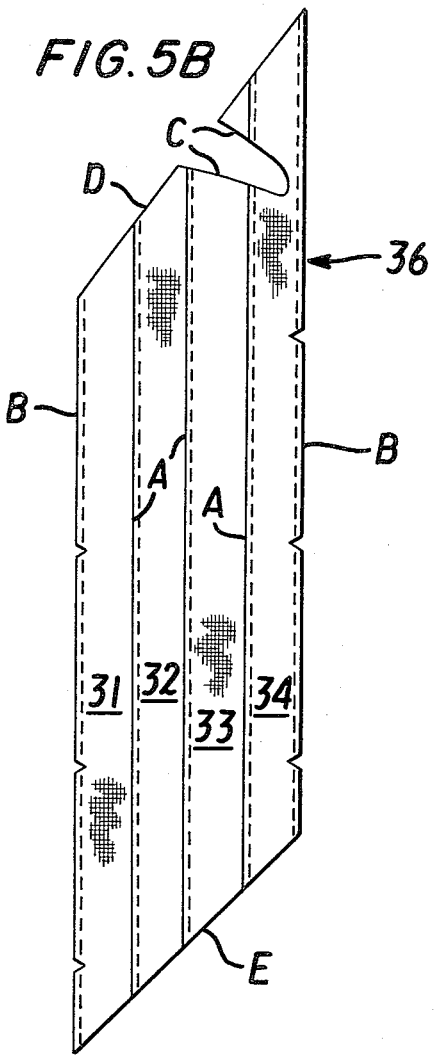
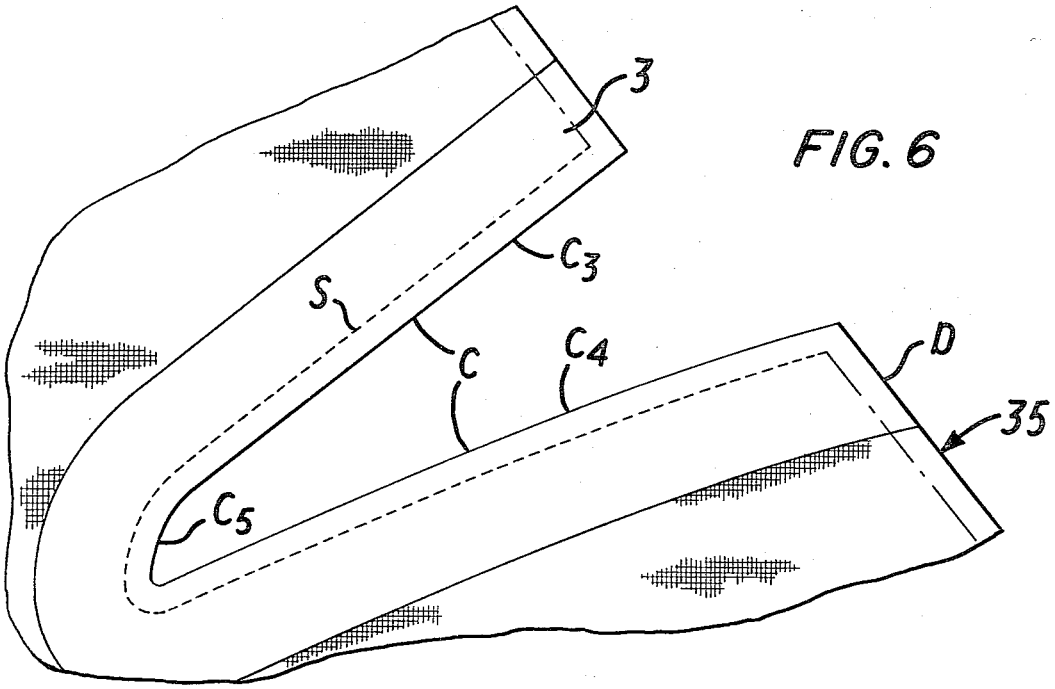
FIG. 6

PANTS-TYPE GARMENT AND METHOD OF MAKING THE SAME

REFERENCE TO PRIOR APPLICATIONS

This application is a continuation-in-part of my application Ser. No. 921,181 filed July 3, 1978 and is directed to an improvement of the invention disclosed in my application Ser. No. 770,034 filed Feb. 18, 1977 now U.S. Pat. No. 4,097,933.

FIELD OF INVENTION

The present invention relates to the construction of pants-type garments. The term "pants-type garment" is used broadly to include pants, slacks, jeans, shorts, culottes, coveralls and similar garments which have a body portion covering at least the lower portion of the torso and leg portions individually covering the legs of a wearer. The present invention is applicable to garments for men, women, children and infants.

BACKGROUND OF THE INVENTION

In my U.S. Pat. No. 4,097,933 there are disclosed pants-type garments formed by bands of material helically wound to form the legs of the garment, upper portions of the strips being cut and joined by a central seam to form a body portion of the garment. A garment of this construction represents an important improvement over earlier pants-type garments made by using a pattern to cut pieces of various sizes and shapes from fabric material which are then sewn together to form the garment. In my application, Ser. No. 921,181, there is disclosed a method and apparatus for making garments of the kind disclosed in U.S. Pat. No. 4,097,933.

SUMMARY OF THE INVENTION

The present invention is directed to an improvement of pants-type garments of the construction disclosed in U.S. Pat. No. 4,097,933 and an improvement of the method disclosed in application, Ser. No. 921,181. In accordance with the present invention a pants-type garment is made of two bands of material each of which is wound helically to form a leg portion of the garment, the edges of each convolution of the garment being joined to edges of adjacent convolutions. Upper end portions of the bands are shaped to form a body portion of the garment with a contoured edge for the formation of a crotch. A crotch band has one side edge joined with the contoured edge of one leg portion and the opposite side edge joined with the contoured edge of the other leg portion so as to unite the two leg portions and form a body portion of the garment. The crotch band extends from the waist line at the back of the garment under the crotch and up to the waist line at the front of the garment.

The construction in accordance with the present invention provides a garment which has a better fit and is more comfortable to wear by a virtue of the greater room provided in the crotch portion of the garment.

The crotch band construction in accordance with the present invention is also applicable to pants-type garments which are otherwise of conventional construction with two panels of material each comprising a lower leg-forming portion and an upper body-forming portion. An upper portion of each panel is provided with a contoured edge for the formation of a crotch. In accordance with the invention, a crotch band has one side edge joined with the contoured edge of one of the panels and the opposite side edge joined with the contoured edge of the other panel so as to unite the two panels and form a body portion of the garment.

BRIEF DESCRIPTION OF THE DRAWINGS

The nature, object and advantages of the invention will be more fully understood from the following description of preferred embodiments shown schematically by way of example in the accompanying drawings in which:

FIGS. 5A and 5B show two bands of material similar to those of FIGS. 1A and 1B but with cutouts for forming the crotch of the garment of different shape and in a different location;

FIG. 6 is a view on a larger scale showing schematically a cutout for formation of the crotch of the garment and a crotch band having one side edge joined to the contoured edge formed by the cutout;

DESCRIPTION OF PREFERRED EMBODIMENTS

Figure 2:
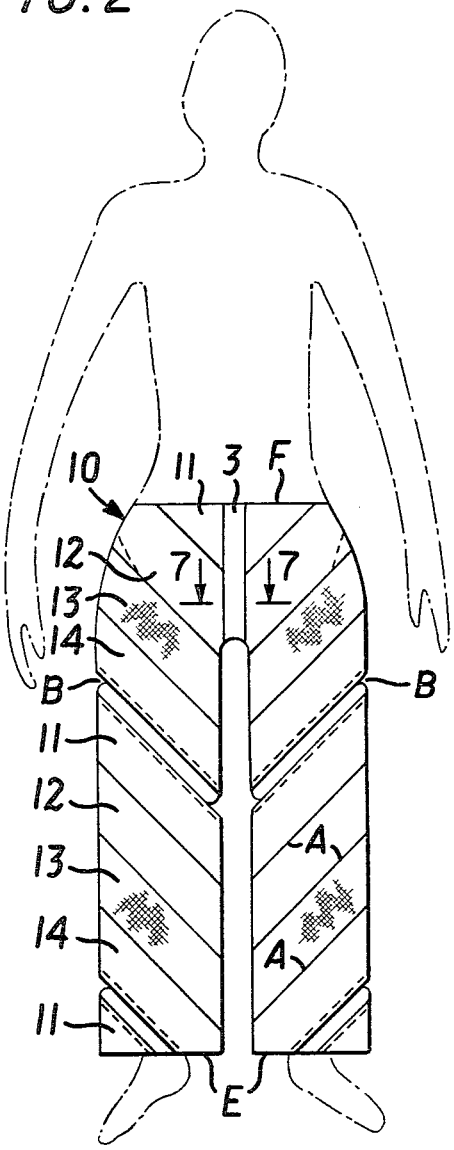
FIG. 2 shows schematically a pants-type garment made in accordance with the present invention from the bands of material shown in FIGS. 1A and 1B wound helically in opposite directions to form leg portions of the garment.
Figures 1A, 1B:
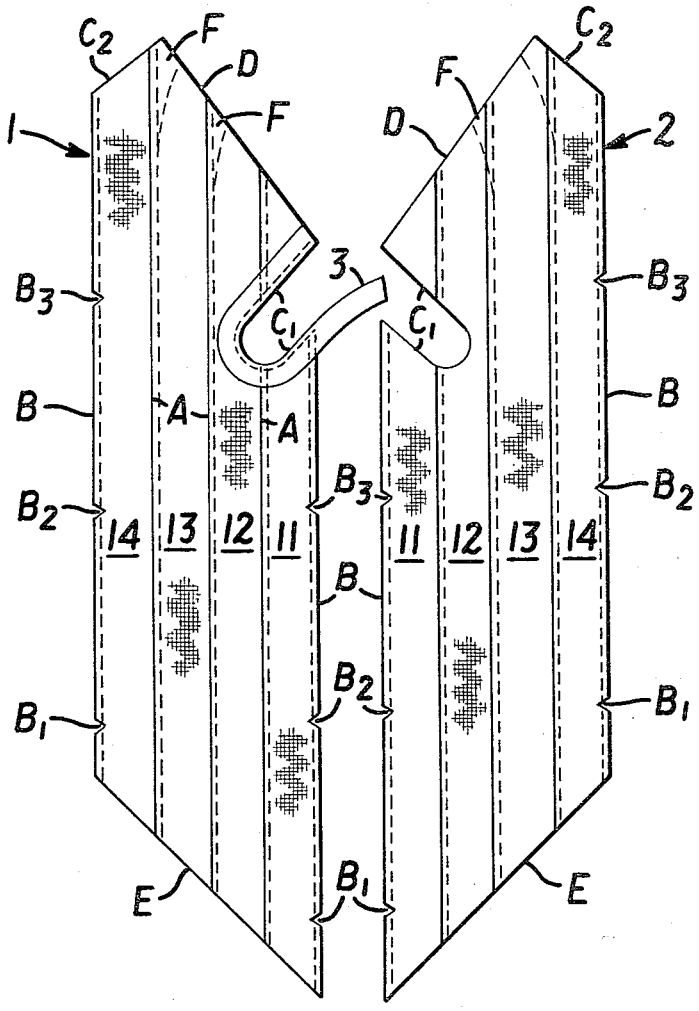
FIGS. 1A and 1B show composite bands of material for making a pants-type garment in accordance with the present invention, each of the composite bands being shown as comprising four narrow strips joined together.

In FIG. 2 there is shown a pair of pants 10 made in accordance with the present invention. FIGS. 1A and 1B show respectively two bands of material 1 and 2 from which the pants shown in FIG. 2 are made. The material for the right leg and corresponding upper part of the pants is shown in FIG. 1A while the material for the left leg and corresponding upper part of the pants is shown in FIG. 1B. It will be seen that the two legs and corresponding upper portions are identical with one another except that one is the reverse or mirror image of the other.

The material for forming each of the legs and the respective upper portion of the garment is shown as a composite band formed of four strips of material 11, 12, 13 and 14. The strips are disposed along side one another and contiguous edges A of adjacent strips are joined by seams to form the composite band 1,2.

The lower edge of the composite band is cut at an angle to provide an inclined edge E which forms the bottom edge of the pants leg. An upper edge D of each of the composite bands is inclined approximately parallel to the edge E and represents the waistline of the garment.

In an upper portion of the material there is provided a contoured edge $C_1$ for the formation of the crotch of the garment. In FIGS. 1A, 1B the contoured edge $C_1$ is shown as a generally U-shape cutout which is formed in an upper portion of the band adjacent the lower end of the inclined edge D. At the upper end of each of the bands there is a short edge $C_2$ which is approximately perpendicular to the inclined edge D and in the finished garment forms in effect a continuation of the lower edge of the cutout $C_1$.

After the strips 11–14 are assembled as shown in FIGS. 1A and 1B, the resulting composite band which is to form each leg of the pants is wound helically as illustrated in FIG. 2. Contiguous side edges B of successive convolutions of the helix thus formed are joined by a continuous seam to form the respective leg of the pants. For clarity of illustration in FIG. 2, the edges B are not shown joined but rather are shown slightly spaced in order to differentiate them from the edges A of the strips which form the respective bands. To assist in winding the two bands helically in proper relation to one another the side edges B may be provided with spaced notches $B_1$, $B_2$ and $B_3$ as illustrated in FIGS. 1A,1B. When the band is wound corresponding notches are brought into coincidence with one another so as properly to position successive convolutions of the band. The notches may if desired be omitted and are not needed when the garment is made by the method and apparatus disclosed in application Ser. No. 921,181.

In accordance with the improvement of the present invention the garment further comprises a crotch band 3. One side edge of the crotch band 3 is joined to the contoured edge $C_1$, $C_2$ of one composite strip 1 while the opposite side edge of the crotch band 3 is joined to the contoured edge $C_1$, $C_2$ of the other band 2 thereby joining upper portions of the bands to form a body portion of the garment covering a lower portion of the torso. In the assembled garment as shown in FIG. 2 the crotch band 3 extends from the waistline at the front of the garment down under the crotch and up to the waistline at the back of the garment.

In assembling the garment, one side edge of the crotch band 3 may be stitched or otherwise joined to the contoured edge $C_1$, $C_2$ of one of the bands 1 after the band has been wound into helical form as illustrated in FIG. 2. The opposite side edge of the crotch band 3 is then stitched or otherwise joined to the contoured edge $C_1$, $C_2$ of the other band 2 after it likewise has been wound into helical form. Alternatively one side edge of the crotch band 3 may be joined to the contoured edge $C_1$ of the band 1 while still in flat form as illustrated by way of example in FIG. 1A. For clarity of illustration the crotch band 3 is shown in FIG. 1A as lying flat although by reason of the curvature of the contoured edge $C_1$, the crotch band 3 would not lie flat when stitched to the composite band 1. After the composite band 1 is wound into helical form, the remaining portion $C_2$ of the contoured edge of the composite band 1 is joined to the remaining portion of the crotch band 3 which in FIG. 1A is shown as projecting beyond the edge B. The opposite edge of the crotch band 3 is thereafter joined to the contoured edge $C_1$, $C_2$ of the other composite band 2.

Figure 7:
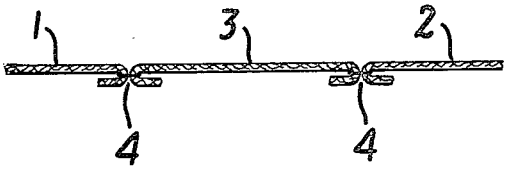
FIG. 7 is an enlarged schematic cross-section taken approximately on the line 7—7 in FIG. 2

The crotch band 3 is shown by way of example as being a straight band of uniform width. According to the size and style of the garment the width of the crotch band is preferably between 1 and 3 inches including suitable seam allowance. The crotch band may be of the same material as the composite bands 1 and 2 or it may be of different material, for example material having greater or less elasticity. If formed of woven material, the grain of the material may extend lengthwise of the band, crosswise or diagonally. In FIG. 7 the crotch band 3 is shown by way of example as being joined with the bands 1 and 2 by stitching 4. However, a different type of seam or different type of joining may be used. If the garment is to have a fly opening, this may be provided by joining the front portion of one side edge of the crotch band with the corresponding portion of the contoured edge of one of the bands 1, 2 by means of a slide fastener or other suitable type of fastener. In case a wider band is used, the fly construction may be within the band.

The waistline of the garment including opposite ends of the crotch band 3 are suitable finished, for example by a hem or a suitable waistband. In order to shape the waist, upper portions of the seams joining the contiguous edges A of strips 12, 13 and 14 can be tapered as is illustrated at F in FIGS. 1A, 1B. The lower edges E of the bands are likewise suitably finished.

While each of the bands 1, 2 forming the legs of the garment is shown as being made of four strips of material of equal width, it will be understood that strips of different widths may be used and also that the number of strips can be varied so long as the widths between the side edges B of the leg portions is correct for the size and type of pants to be made. Moreover, it will be understood that the pants construction as illustrated and described is applicable to other pants-type garments such as slacks, jeans, shorts and culottes. The material used is selected so as to be appropriate for the type of garment being made. When each of the pants leg is made of a plurality of strips of material as illustrated, many different styling effects can be obtained by selecting the material used for the respective strips. Thus the strips can, if desired, be made of different pattern, color, texture, or material. One or more of the strips can if desired be made of elastic material so as to provide the garment with greater elasticity.

Figure 4:
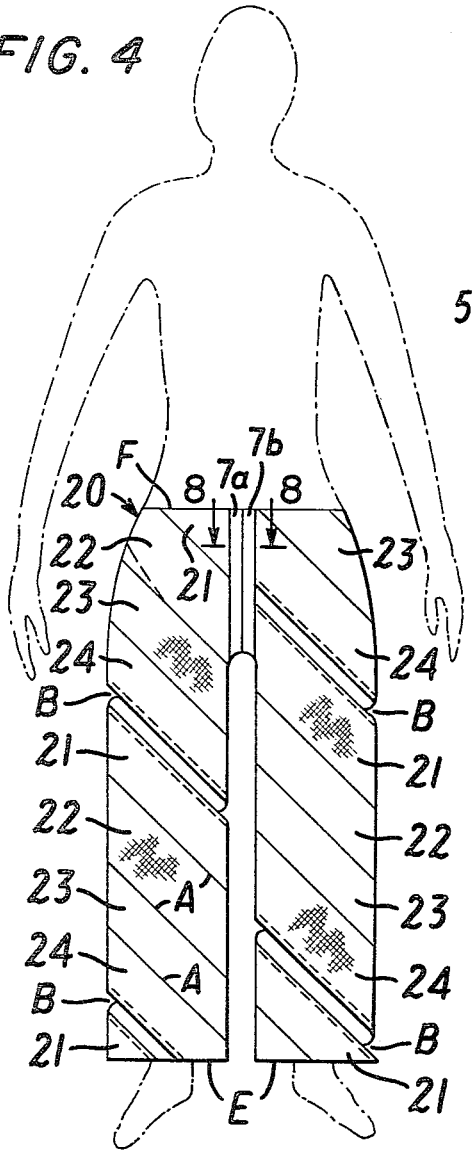
FIG. 4 shows schematically a pants-type garment made from the bands of material shown in FIGS. 3A and 3B wound helically in the same direction to form leg portions of the garment.

In FIG. 4 there is shown a pair of pants 20 which is similar to the pants 10 shown in FIG. 2 but differs in that the strips forming the two legs of the pants in FIG. 4 spiral in the same direction while in the pants of FIG. 2, the strips forming the two legs spiral in opposite directions. The pants of FIG. 4 are made from two composite bands of material 5 and 6 shown respectively in FIGS. 3A and 3B. Each of the composite bands 5, 6 is shown as being composed of four strips of material 21,22,23 and 24 which are disposed side-by-side with contiguous edges A joined by seams. The composite band 5 for forming one leg of the pants is similar to, but not identical with, the composite band 6 forming the other leg. The lower end of each of the composite bands has an edge E which is inclined at an angle of about 45° to the side edges. This edge forms the bottoms of the respective pants legs. At its upper edge each of the bands has an inclined edge D which is approximately parallel to the lower edge E and forms the waistline of the pants. In the upper portion of the band there is formed a contoured edge $C_1$ for the formation of the crotch of the garment. As shown by way of example in FIGS. 3A and 3B, the contoured edge $C_1$ defines a generally U-shaped cutout in the side edge of the band at the lower end of the inclined edge D. At the upper end of each band there is a short inclined edge $C_2$ which is approximately perpendicular to the edge D. The edge $C_2$ forms, in effect, a continuation of the contoured edge $C_1$ when the garment is assembled. It will be noted that the contoured edge $C_2$ of the composite band 5 is slightly longer than the contoured edge $C_2$ of the other composite band 6. Conversely the length of the contoured edge $C_1$ of the composite band 5 is slightly less than the length of the contoured edge $C_1$ of composite band 6 so that the total length of the contoured edge $C_1$, $C_2$ of the composite band 5 is equal to the total length of the contoured edge $C_1$, $C_2$ of the composite band 6.

Figure 8:
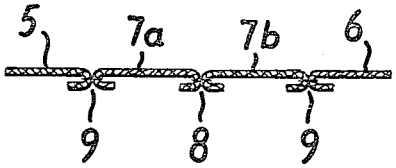
FIG. 8 is an enlarged schematic cross-section taken approximately on the line 8—8 in FIG. 4.

The material for the pants shown in FIG. 4 further comprises a crotch band which in this case is shown as comprising two strips 7a, 7b joined by a seam 8 (see FIG. 8). When the garment is assembled, one side edge of the crotch band 7a, 7b is joined to the contoured edge $C_1$, $C_2$ of the composite band 5 while the opposite edge of the crotch band is joined to the contoured edge $C_1$, $C_2$ of the composite band 6. In FIG. 8 the crotch band 7a, 7b is shown as being joined with the bands 5 and 6 by stitching 9. However as described above with respect to FIG. 2 other types of seams or joining maybe used as desired.

Figure 3A:
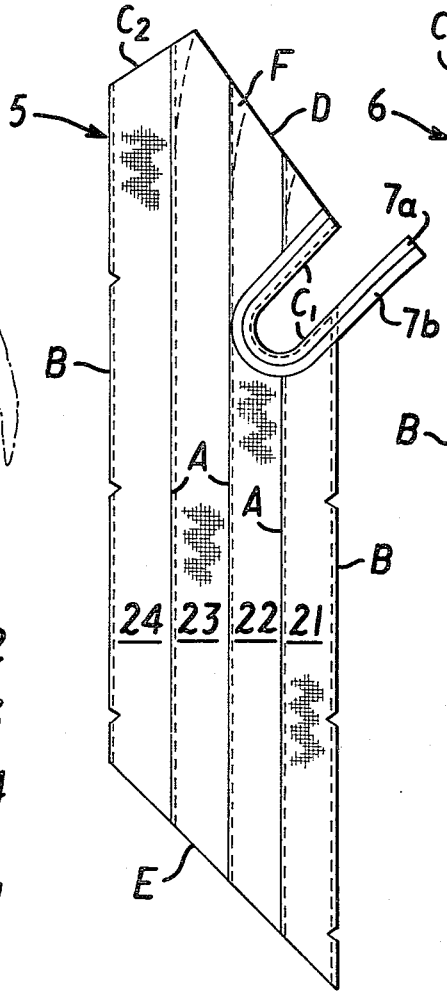
FIGS. 3A and 3B show a composite bands of material for making a garment of the kind shown in FIG. 4.
Figure 3B:
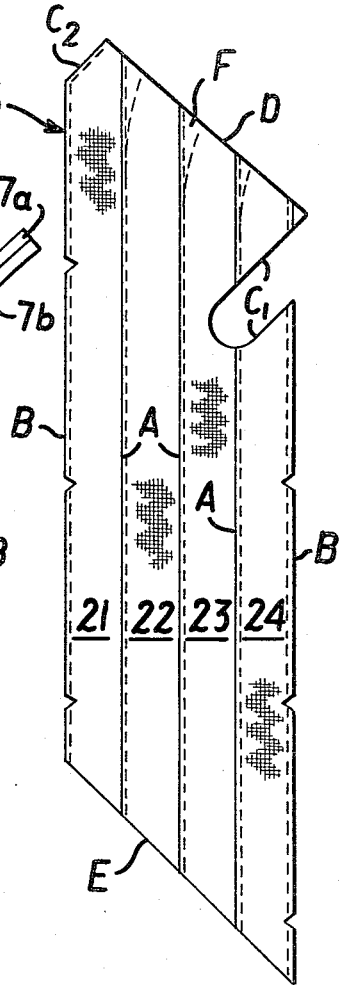

The pants shown in FIG. 4 are assembled from the composite bands 5 and 6 and the crotch band 7a, 7b shown in FIGS. 3a and 3b in the manner described above with reference to the pants of FIG. 2 except that the composite bands 5 and 6 are wound helically in the same direction as illustrated in FIG. 4. Hence the description of the assembling operation need not be repeated.

The cutouts for forming the crotch of the garment need not be in the location illustrated in FIGS. 1a, 1b and FIGS. 3a, 3b. Thus by way of example, FIGS. 5a and 5b show composite bands of material 35 and 36 for forming the legs and associated body portion of a pants-type garment. Each of the bands is shown as being composed of strips 31, 32,33, and 34 arranged side-by-side and joined at contiguous edges A. Each of the composite bands has longitudinally extended side edges B, an inclined upper edge D and an inclined lower edge E. In the inclined upper edge D there is provided a cutout C providing a contoured edge for the formation of the crotch of the garment. The portion of the band containing the cutout C is shown on a larger scale in FIG. 6. It will be seen that the cutout is generally U-shaped with opposite sides $C_3$ and $C_4$ joined by an asymmetrically curved portion $C_5$. The two sides $C_3$ and $C_4$ are disposed at an angle to one another and the side $C_4$, which in the assembled garment is at the rear, is somewhat longer than the side $C_3$. A crotch band 3 is shown stitched to the contoured edge provided by the cutout C of the band 35 by a line of stitches S.

In accordance with the present invention, the cutout C for forming the crotch is longer and narrower than the crotch cutout of a conventional pants-type garment. As illustrated by way of example in FIG. 5, the depth of the cutout C (measured to the seam line S) in an adult-size garment is approximately 14 to 16 inches and the width at the open end of the cutout (likeside measured to the seam line) is approximately 4 to 6 inches. Thus the depth of the cutout is more than twice its width at the open end. Preferably the depth of the cutout is between two and four times the width at the open end. The size of the cutout will, of course, vary with the size of the garment but the shape of the cutout and its proportions preferably remain substantially the same.

FIGS. 1a, 1b and FIGS. 5a, 5b illustrate in effect the limits of the location of the cutout for forming the crotch of the garment. Thus the cutout can be at any desired location between the position illustrated in FIGS. 1a, 1b and the position illustrated in FIGS. 5a, 5b.

The composite bands 35 and 36 shown in FIGS. 5a and 5b together with the crotch band 3 are assembled into a garment as described above with reference to FIGS. 1a, 1b and 2 by winding each of the bands helically to form a leg of the garment, joining the edges B of consecutive convolutions of the helix and joining opposite side edges of the crotch band 3 to the contoured edges of the cutouts C in order to unite the two leg portions and form the body portion of the garment. Thus the manner of assembling the garment need not be further described.

While preferred embodiments of invention have been illustrated by way of example in the drawings and are herein particularly described, it will be understood that the invention is in no way limited to these embodiments. Thus the garments can be made in the form of pants, slacks, jeans, shorts, culottes, coveralls or other forms of pants-type garments. Moreover while the crotch band by which the two halves of the garment are united is shown as being a band of uniform width, it may, if desired, be tapered or may have a central portion that is wider or narrower than end portions. As will be understood by those skilled in the art many modifications are possible within the ambit of the invention.

What I claim is:

1. A pants-type garment comprising two bands of material each of which is wound helically to form a leg portion of said garment, means joining adjacent edges of adjacent convolutions of said bands, upper end portions of said material being shaped to form a body portion of said garment with a contoured edge shaped for the formation of a crotch, a crotch band having opposite side edges, means joining one of said side edges of said crotch band with said contoured edge of one leg portion, and means joining the opposite side edge of said crotch band with said contoured edge of the other leg portion to unite said two leg portions and form a body portion of said garment.

2. A pants-type garment according to claim 1, in which the band forming one leg portion is wound helically in the opposite direction to the helical winding of the band forming the other leg portion of said garment.

3. A pants-type garment according to claim 1, in which the band forming one leg portion is wound helically in the same direction as the helical winding of the band forming the other leg portion of the garment.

4. A pants-type garment according to claim 1, in which each of said bands comprises a plurality of strips of material joined edge-to-edge along junction lines extending lengthwise of said bands.

5. A pants-type garment according to claim 1, in which said contoured edge of each of said bands defines a generally U-shaped cutout in an upper portion of said band.

6. A pants-type garment according to claim 5, in which said cut-out has a depth which is approximately two to four times the width of said cut-out at its open end.

7. A pants-type garment comprising two panels of material, each of said panels comprising a lower leg-forming portion and an upper body-forming portion having a contoured edge for the formation of a crotch, a crotch band having opposite side edges, means joining one of said side edges of said crotch band with said contoured edge of one of said panels, and means joining the opposite side edge of said crotch band with said contoured edge of the other of said panels to unite said two panels and form a body portion of said garment.

8. A pants-type garment according to claim 7, in which said contoured edge of each of said panels defines a generally U-shaped cut-out.

9. A pants-type garment according to claim 8, in which said U-shaped cut-out has a depth which is approximately two to four times its width at the open end of said cut-out.

10. A pants-type garment according to claim 7, in which said crotch band is of elastic material.

11. A method of making a pants-type garment which comprises providing two panels of material each comprising a lower leg-forming portion and an upper body-forming portion having a contoured edge for the formation of a crotch, providing a crotch band having opposite side edges, joining one of said side edges of said crotch band with said contoured edge of one of said panels, and joining the opposite side edge of said crotch band with the contoured edge of the other of said panels to unite said two panels and form a body portion of said garment.

12. A method according to claim 10, in which said contoured edge of each of said panels is formed as a generally U-shaped cutout.

13. A method according to claim 11, in which the depth of said U-shaped cutout is approximately two to four times the width of said cutout at its open end.

14. A method according to claim 11, in which each of said panels of material comprises a band of material which is wound helically to form a leg portion of the garment.

* * * * *